US012532978B2

(12) United States Patent
Zhang et al.

(10) Patent No.: US 12,532,978 B2
(45) Date of Patent: Jan. 27, 2026

(54) DIRECT-DRINKING CONTAINER LID WITH ONE-KEY CONTROL FUNCTION

(71) Applicant: Zhejiang Ansheng Science & Technology Stock Co., Ltd., Zhejiang (CN)

(72) Inventors: Mingyong Zhang, Zhejiang (CN); Qiuxia Luo, Zhejiang (CN)

(73) Assignee: ZHEJIANG ANSHENG SCIENCE & TECHNOLOGY STOCK CO., LTD., Yongkang (CN)

( * ) Notice: Subject to any disclaimer, the term of this patent is extended or adjusted under 35 U.S.C. 154(b) by 41 days.

(21) Appl. No.: 18/432,080

(22) Filed: Feb. 5, 2024

(65) Prior Publication Data

US 2025/0248548 A1 Aug. 7, 2025

(51) Int. Cl.
*A47G 19/22* (2006.01)
*B65D 47/06* (2006.01)

(52) U.S. Cl.
CPC ..... *A47G 19/2272* (2013.01); *B65D 47/065* (2013.01)

(58) Field of Classification Search
CPC ..... A47G 19/2272; B65D 47/065
See application file for complete search history.

(56) References Cited

U.S. PATENT DOCUMENTS

| | | | | |
|---|---|---|---|---|
| 11,479,390 | B1 * | 10/2022 | Salvador-Zamora | B65D 47/0857 |
| 2015/0173539 | A1 * | 6/2015 | Mason | A47G 19/2272 220/715 |
| 2017/0144804 | A1 * | 5/2017 | Bois | B65D 53/00 |
| 2024/0059461 | A1 * | 2/2024 | Wong | B65D 47/066 |

* cited by examiner

*Primary Examiner* — Shawn M Braden

(57) ABSTRACT

The application discloses a direct-drinking container lid with a one-key control function, and relates to the technical field of daily necessities. The direct-drinking container lid with a one-key control function comprises a carrier; a first water outlet part which is bendable, penetrates through the carrier and is used for liquid circulation; a moving part which is able to drive the first water outlet part to be folded to prevent liquid circulation; and a control member which is movably arranged on the carrier and used for controlling the moving part to move. The direct-drinking container lid with a one-key control function can improve the drinking convenience of containers.

18 Claims, 9 Drawing Sheets

DIRECT-DRINKING CONTAINER LID WITH ONE-KEY CONTROL FUNCTION

BACKGROUND OF THE INVENTION

1. Technical Field

The application relates to the technical field of daily necessities, and particularly relates to a direct-drinking container lid with a one-key control function.

2. Description of Related Art

The container lid, as one important part of containers, can block dust and isolate air.

In the prior art, in use of containers, after a flip cover is separated from a cover seat by pressing a button, the flip cover cannot bounce automatically and needs to be manually flipped; and when drinking, users need to tilt up the cup body, which will in turn block the user's vision, causing inconvenience.

BRIEF SUMMARY OF THE INVENTION

To improve the drinking convenience of containers, the application provides a direct-drinking container lid with a one-key control function.

The direct-drinking container lid with a one-key control function provided by the application adopts the following technical solution:

The direct-drinking container lid with a one-key control function comprises: a carrier; a first water outlet part which is bendable, penetrates through the carrier and is used for liquid circulation; a moving part which is able to drive the first water outlet part to be folded to prevent liquid circulation; and a control member which is movably arranged on the carrier and used for controlling the moving part to move.

By adopting the above technical solution, the control member can move to drive the moving part to move, and the moving part can drive the first water outlet part to be folded or not folded; when the first water outlet part is not folded, liquid in the first water outlet part can circulate to allow users to drink water smoothly, thus fulfilling the direct drinking function; and when the first water outlet part is folded, liquid in the first water outlet part cannot circulate, and the first water outlet part can be folded merely by controlling the moving part to move, thus fulfilling the one-key control function.

Optionally, a receiving cavity is formed in the carrier, the first water outlet part and the control member are movably arranged in the receiving cavity, and when an end of the first water outlet part is received in the receiving cavity, liquid is prevented from circulating in the first water outlet part.

By adopting the above technical solution, the first water outlet part and the control member are movably arranged in the receiving cavity, thus guaranteeing the flatness of the top of the carrier and improving the aesthetics of the carrier; moreover, when the end of the first water outlet part is received in the receiving cavity, the first water outlet part will not be seen from the outside, that is, the first water outlet part is in a folded state, thus further improving the aesthetics; in addition, because the first water outlet part is arranged in the receiving cavity, the possibility of dust contamination of the first water outlet part is reduced.

Optionally, a support part is rotatably arranged on the carrier, the first water outlet part penetrates into the support part, and the support part is able to drive the first water outlet part to move.

By adopting the above technical solution, because the first water outlet part is foldable, the first water outlet part is made from a soft material, and the support part is arranged to improve the strength of the first water outlet part; moreover, the support part can be controlled to rotate to drive the first water outlet part to be folded, such that the first water outlet part can be controlled to move more easily.

Optionally, first connecting protrusions are fixed to the moving part, second connecting protrusions are fixed to the control member, and the first connecting protrusions are in snap fit with the second connecting protrusions.

By adopting the above technical solution, the first connecting protrusions on the moving part can be in snap fit with the second connecting protrusions on the control member to fix the moving part and the control member together; the control member can be controlled to move to separate the first connecting protrusions from the second connecting protrusions so as to separate the moving part from the control member to facilitate the movement of the moving part; and when the moving part and the control member are connected, the first water outlet part is in a folded state under the action of the moving part.

Optionally, a control groove is formed in a side wall of the carrier, the control member comprises a first control part and a second control part, the first control part penetrates into the control groove and extends out of the carrier, the second connecting protrusions are fixed to the second control part, and a portion, outside the carrier, of the first control part is located at a position away from the end of the first water outlet part in a folded state.

By adopting the above technical solution, the first control part penetrates into the control groove and extends out of the carrier, such that the first control part can be controlled outside the carrier to move to drive the control member to move, so as to drive the second control part and the second connecting protrusions to move, thus facilitating connection and separation of the control member and the moving part.

Optionally, a return element is arranged on the carrier, and the return element is elastic and is able to drive the first control part to move to return.

By adopting the above technical solution, the return element is elastic and is able to drive the first control part to move to return, and when pressed, the first control part can return to the original position under the action of the return element, thus facilitating the next operation.

Optionally, first stop blocks for limiting a position of the control member are fixed to the carrier, and second stop blocks which are able to come in contact with the first blocks are fixed to the second control part.

By adopting the above technical solution, the first stop blocks and the second stop block can come into contact, the first stop blocks are fixed to the carrier, the second stop blocks are fixed to the second control part, and the second stop blocks can come in contact with the first stop blocks to limit the position of the second control part, thus limiting the control member.

Optionally, a contact protrusion is fixed to a side wall of the support part, a rotating shaft of the support part is arranged on the contact protrusion, and a first plane, a second plane and an arc surface which facilitate rotation of the contact protrusion are arranged on the contact protrusion.

By adopting the above technical solution, the first plane, the second plane and the arc surface which facilitate rotation of the contact protrusion are arranged on the contact protrusion, such that the support part can rotate smoothly; because the rotating shaft is arranged on the contact protrusion, the diameter of the contact protrusion is greater than that of the rotating shaft, the first plane, the second plane and the arc surface will not hinder the rotation of the support part, and the first plane and the second plane can act on the moving part.

Optionally, a moving groove is formed in the moving part, the support part penetrates into the moving groove, and when the first connecting protrusions are in snap fit with the second connecting protrusions, an end face of the support part is attached to an end face of the moving part.

By adopting the above technical solution, when the first connecting protrusions on the moving part are in snap fit with the second connecting protrusions, the end face of the support part is attached to the end face of the moving part, at this moment, the first water outlet part is in a folded state and received in the receiving cavity, and the support part and the moving part are horizontal, thus guaranteeing the bending degree of the first water outlet part; and the first water outlet part is bent by 90°, thus further reducing the possibility of liquid circulation in the first water outlet part in the bent state.

Optionally, a locking piece is slidably arranged in the receiving cavity and is able to slide to hinder movement of the control member.

By adopting the above technical solution, the locking piece is slidably arranged in the receiving cavity and can be controlled to slide in the receiving cavity to hinder movement of the control member so as to prevent the control member from being pressed, thus reducing the possibility of separation of the first connecting protrusions from the second connecting protrusions caused by autonomous movement of the control member.

Optionally, a locking groove is formed in the control member, and the locking piece is able to slide into the locking groove to prevent the control member from moving.

By adopting the above technical solution, the locking groove is formed in the control member, and the locking piece can slide into the locking groove to prevent the control member from moving, such that the movement of the control member is limited, and the possibility of liquid circulation caused by mistouch of the control member is reduced.

Optionally, an operating groove connected to the receiving cavity is formed in the carrier, and a locking protrusion is fixed to the locking piece and penetrates into the operating groove.

By adopting the above technical solution, the locking protrusion penetrates into the operating groove and the operating groove is connected to the receiving cavity, that is, the locking protrusion can be controlled outside the carrier to move to drive the locking piece to move, such that the locking piece can be controlled more easily.

Optionally, a positioning piece is fixed to the locking piece, a buffer gap is reserved between the positioning piece and the locking piece, a positioning protrusion is fixed to the positioning piece, and a first limiting part is fixed to the carrier.

By adopting the above technical solution, the buffer gap is reserved between the positioning piece and the locking piece, the positioning protrusion is fixed to the positioning piece, and the first limiting part is fixed to the carrier; the first limiting part can facilitate the installation of the locking piece and fulfill a positioning function; and during the installation process, a side wall of the first limiting part is attached to a side wall of the positioning piece, thus reducing the possibility of skewing of the locking piece.

Optionally, a covering part is arranged in the receiving cavity, the covering part covers the receiving cavity and has a space for the first water outlet part, the moving part and the control part to move; the covering part comprises a first horizontal part, a first vertical part and a second vertical part, and end faces of the first horizontal part and the moving part are flush when the first horizontal part and the moving part are horizontal; and the first vertical part abuts against a bottom of an inner side of the receiving cavity, and the first water outlet part, the moving part and the control member are all arranged in the first vertical part.

By adopting the above technical solution, the first water outlet part, the moving part and the control member are all arranged in the first vertical part, and the other part of the receiving cavity is covered by the first horizontal part, thus increasing the space utilization rate.

Optionally, a space for the locking piece to move is reserved between the second vertical part and an inner wall of the receiving cavity; the second vertical part comprises a first positioning part and a second positioning part, a transition part is fixed between the first positioning part and the second positioning part, and ends of the transition part in contact with the first positioning part and the second positioning part are oblique; and the first positioning part is used for receiving the positioning piece and the positioning protrusion, and the second positioning part is used for receiving the positioning protrusion.

By adopting the above technical solution, the first positioning part, the second positioning part and the transition part work together to limit the position of the positioning protrusion, thus improving the stability of the locking piece; moreover, the height of the transition part is different from the height of the first positioning part and the height of the second positioning part, such that users can clearly feel a rebound force transferred from the positioning piece to the locking piece when pressing the locking piece to move, and can know whether or not the locking piece moves in position.

Optionally, a positioning guide surface is arranged on the positioning protrusion.

By adopting the above technical solution, the positioning guide surface arranged on the positioning protrusion can facilitate the movement of the positioning protrusion.

Optionally, a limiting groove is formed in the first vertical part, a limiting block is fixed to the control member, and the limiting block penetrates into the limiting groove and is able to slide in the limiting groove.

By adopting the above technical solution, the limiting block penetrates into the limiting groove and is able to slide in the limiting groove, thus further limiting the control member and improving the stability of the control member.

Optionally, a support channel is fixed to the carrier, and the first water outlet part is fixed in the support channel.

By adopting the above technical solution, the first water outlet part is fixed in the support channel, and the support channel is fixed to the carrier, such that the first water outlet part is fixed to the carrier.

Optionally, a connecting part for connecting the carrier to a container is fixed to the carrier, a sealing part is fixed to the carrier, the sealing part is ring-shaped and is attached to the connecting part, and a pulling part is fixed to the sealing part.

By adopting the above technical solution, the sealing part improves the sealing performance between the carrier and the container, and the pulling part facilitates assembly or disassembly of the sealing part, thus making the operation process simple.

Optionally, an air hole is formed in the carrier.

By adopting the above technical solution, the air hole facilitates direct drinking.

To sum up, the direct-drinking container lid with a one-key control function provided by the invention has at least one of the following beneficial effects:

1. The control member can move to drive the moving part to move, and the moving part can drive the first water outlet part to be folded or not folded; when the first water outlet part is not folded, liquid in the first water outlet part can circulate to allow users to drink water smoothly, thus fulfilling the direct drinking function; and when the first water outlet part is folded, liquid in the first water outlet part cannot circulate, and the first water outlet part can be folded merely by controlling the moving part to move, thus fulfilling the one-key control function.

2. The locking piece is slidably arranged in the receiving cavity and can be controlled to slide in the receiving cavity to hinder movement of the control member so as to prevent the control member from being pressed, thus reducing the possibility of separation of the first connecting protrusions from the second connecting protrusions caused by autonomous movement of the control member.

3. After the control member is pressed, the first water outlet part can bounce out, such that users can drink water without tilting up a container; and user's vision will not be blocked, so the container lid is suitable for a case where users need to keep eyes on roads during driving.

REFERENCE SIGNS

1, carrier; 2, first water outlet part; 3, moving part; 4, control member; 5, receiving cavity; 6, support part; 7, first connecting protrusion; 8, second connecting protrusion; 9, control groove; 10, first control part; 11, second control part; 12, return element; 13, first stop block; 14, second stop block; 15, contact protrusion; 16, first plane; 17, second plane; 18, arc surface; 19, moving groove; 20, locking piece; 21, locking groove; 22, operating groove; 23, locking protrusion; 24, positioning piece; 25, positioning protrusion; 26, first limiting part; 27, positioning guide surface; 28, first horizontal part; 29, first vertical part; 30, second vertical part; 31, first positioning part; 32, second positioning part; 33, transition part; 34, limiting groove; 35, limiting block; 36, support channel; 37, connecting part; 38, sealing part; 39, pulling part; 40, air hole; 41, covering part; 42, connecting hole; 43, first connecting groove; 44, first connecting guide surface; 45, second connecting groove; 46, second connecting guide surface; 47, return block; 48, return groove; 49, transition rod; 50, handle.

DETAILED DESCRIPTION OF THE INVENTION

The application will be described in further detail below in conjunction with FIGS. 1-9.

Embodiment 1

Figure 1:
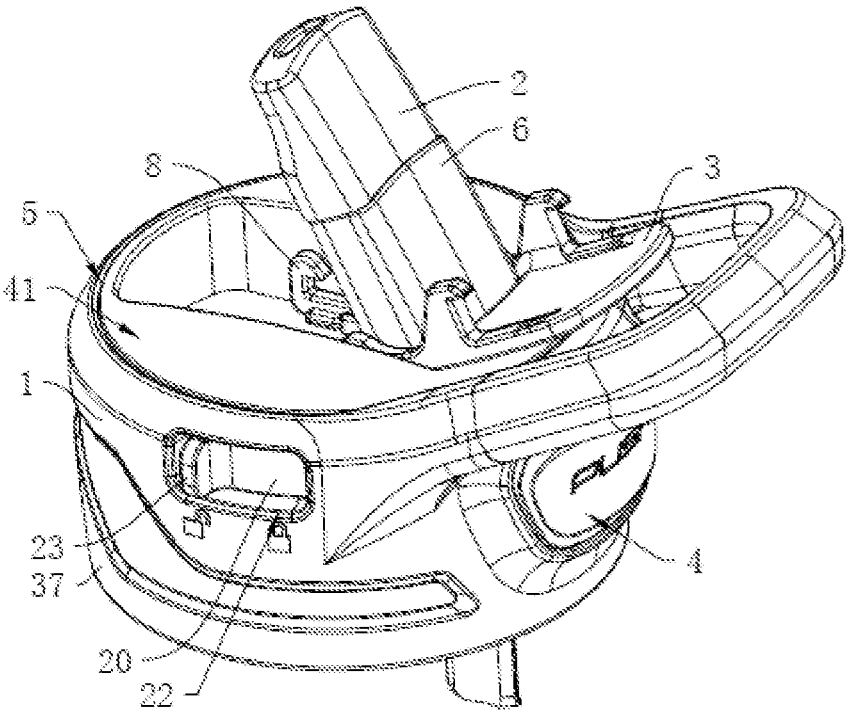
FIG. 1 is a schematic diagram of a main structure according to Embodiment 1 of the application.
Figure 2:
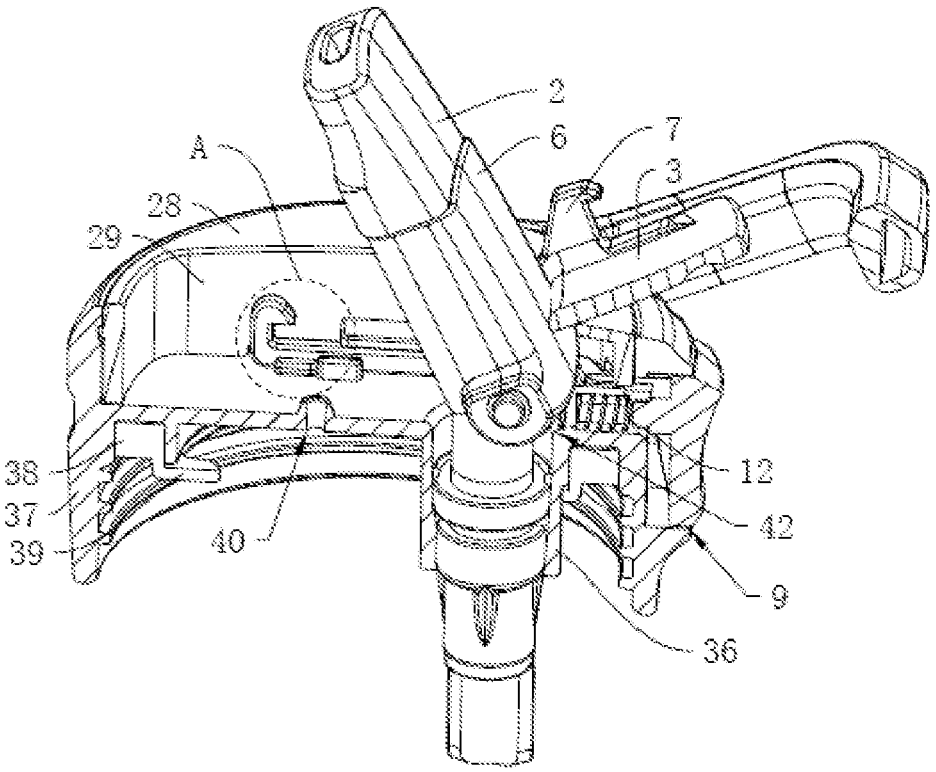
FIG. 2 is a sectional view of the main structure according to Embodiment 1 of the application.
Figure 3:
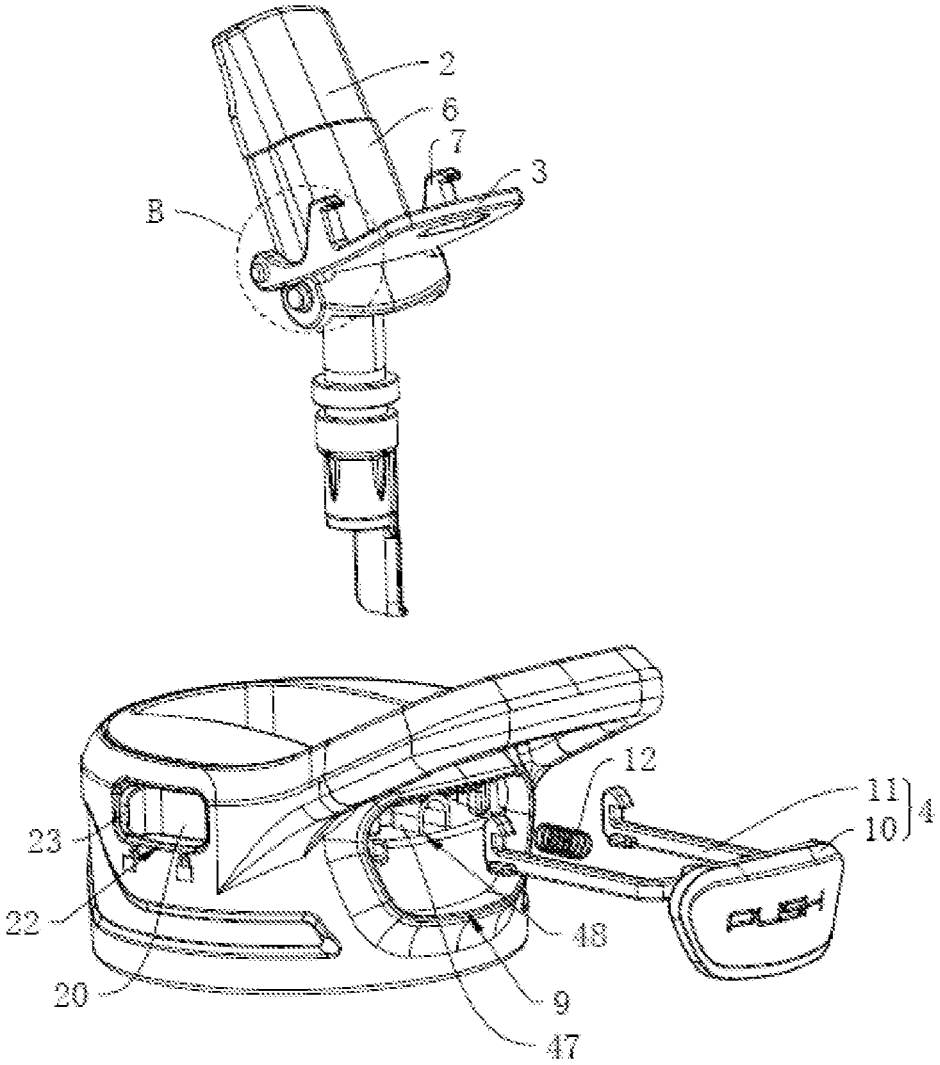
FIG. 3 is an exploded view of the main structure according to Embodiment 1 of the application.

This embodiment of the application discloses a direct-drinking container lid with a one-key control function. Referring to FIG. 1, FIG. 2 and FIG. 3, the direct-drinking container lid with a one-key control function comprises a carrier 1, wherein the carrier 1 is arranged at an opening of a container to seal the opening of the container, a first water outlet part 2 is arranged on the carrier 1 and penetrates through the carrier 1, and the first water outlet part 2 is hollow and connects two end faces of the carrier 1, such that the inside of the container is connected to the outside, and liquid in the container can be transferred out of the container, that is, the first water outlet part 2 is mainly used for liquid circulation; the first water outlet part 2 may be a rigid hollow tube or a flexible hollow tube; in this embodiment, the first water outlet part 2 is a flexible control tube and is made from silicone harmless to humans; because the silicone is soft, the first water outlet part 2 is bendable; when bent, the first water outlet part 2 will be folded, and liquid cannot circulate in the first water outlet part 2 anymore, thus preventing liquid circulation; a moving part 3 is arranged on the carrier 1 and is able to push the first water outlet part 2 to be folded to stop water circulation in the first water outlet part 2; a control member 4 is movably arranged on the carrier 1 and is able to control the moving part 3 to move to drive the first water outlet part 2 to move, and the control member 4 is partially extends out of the carrier 1, such that the control member 4 can be externally controlled to move.

Referring to FIG. 1, FIG. 2 and FIG. 3, a connecting hole 42 is formed in the carrier 1 and penetrates through the carrier 1 in an axial direction of the carrier 1, the first water outlet part 2 penetrates into the connecting hole 42, and a receiving cavity 5 is formed in the carrier 1; in this embodiment, the receiving cavity 5 has a circular cross-sectional shape, is coaxial with the carrier 1 and is arranged on an end face, away from the container, of the carrier 1; the first water outlet part 2, the control member 4 and the moving part 3 are all arranged in the receiving cavity 5; the first water outlet part 2 is completely located in the first receiving cavity 5 in a bent state, at this moment, the end of the first water outlet part 2 is located in the receiving cavity 5, and the first water outlet part 2 penetrating through the carrier 1 is bent to prevent liquid circulation; when the end of the first water outlet part 2 is located outside the receiving cavity 5, the first water outlet part 2 is released from the bent state to allow liquid to circulate therein, such that liquid in the container can be transferred out of the container.

Referring to FIG. 1 and FIG. 2, a support part 6 is rotatably arranged on the carrier 1 by means of a rotating shaft, the support part 6 is hollow, the first water outlet part 2 penetrates into the support part 6, and the moving part 3 is able to control the support part 6 to rotate to drive the first water outlet part 2 to rotate.

Figure 4:
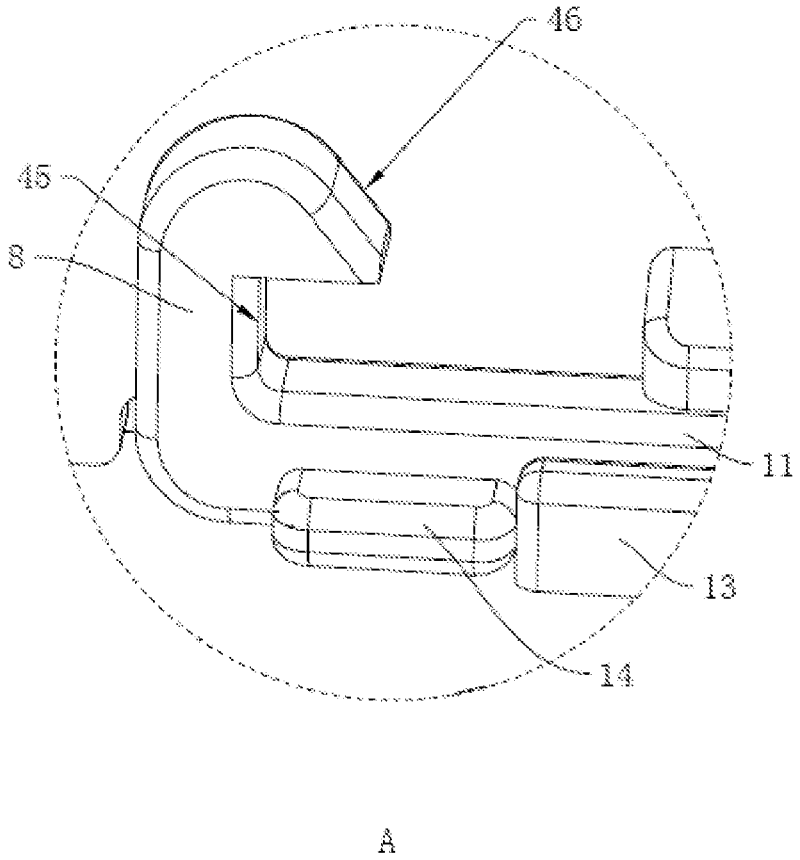
FIG. 4 is an enlarged view of part A in FIG. 2.
Figure 5:
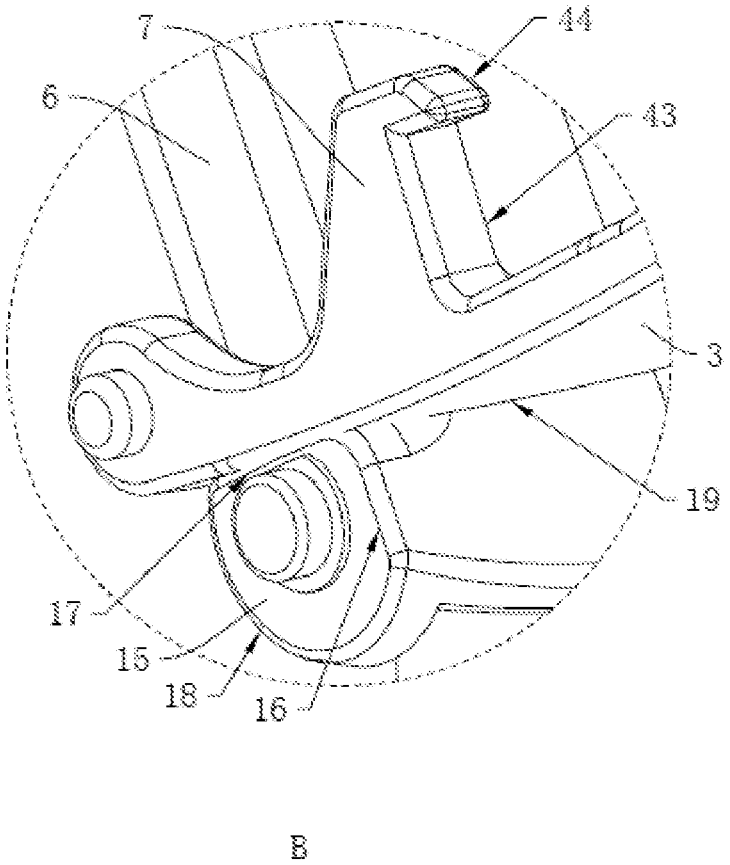
FIG. 5 is an enlarged view of part B in FIG. 3.

Referring to FIG. 3, FIG. 4 and FIG. 5, first connecting protrusions 7 are integrally fixed to the moving part 3, second connecting protrusions 8 are integrally formed on the control member 4, the first connecting protrusions 7 and the second connecting protrusions 8 are in a snap fit, the first connecting portions 7 are able to rotate with the moving part 3, first connecting grooves 43 are formed in the first connecting protrusions 7, first connecting guide surfaces 44 are formed on side walls of the first connecting protrusions 7, and when the first connecting protrusions 7 are located in the receiving cavity 5, the first connecting guide surfaces 44 are located at bottoms of the first connecting protrusions 7; second connecting grooves 45 are formed in the second connecting protrusions 8, and second connecting guide surfaces 46 are formed on the second connecting protrusions 8 and located at the tops of the second connecting protrusions 8 and are able to slide in the receiving cavity 5 with the control member 4; the moving part 3 is able to rotate in the receiving cavity 5, and when the moving part 3 rotates, the first connecting guide surfaces 44 come in contact with the second connecting guide surfaces 46 and drive the second connecting guide surfaces 46 to move to push the first connecting protrusions 7 to move, then the second connecting protrusions 8 are pushed to return, and at this moment, the first connecting protrusions 7 are partially located in the second connecting grooves 45 and the second connecting protrusions 8 are partially located in the first connecting grooves 43, such that the first connecting protrusions 7 and the second connecting protrusions 8 come in snap fit with each other; at this moment, the moving part 3 cannot rotate anymore, the control member 4 is driven to move to separate the first connecting protrusions 7 from the second connecting protrusions 8, and under the action of the elasticity of the silicone flexible tube, the end of the first connecting part 37 will bounce out of the receiving cavity 5 to allow users to drink water smoothly.

Figure 6:
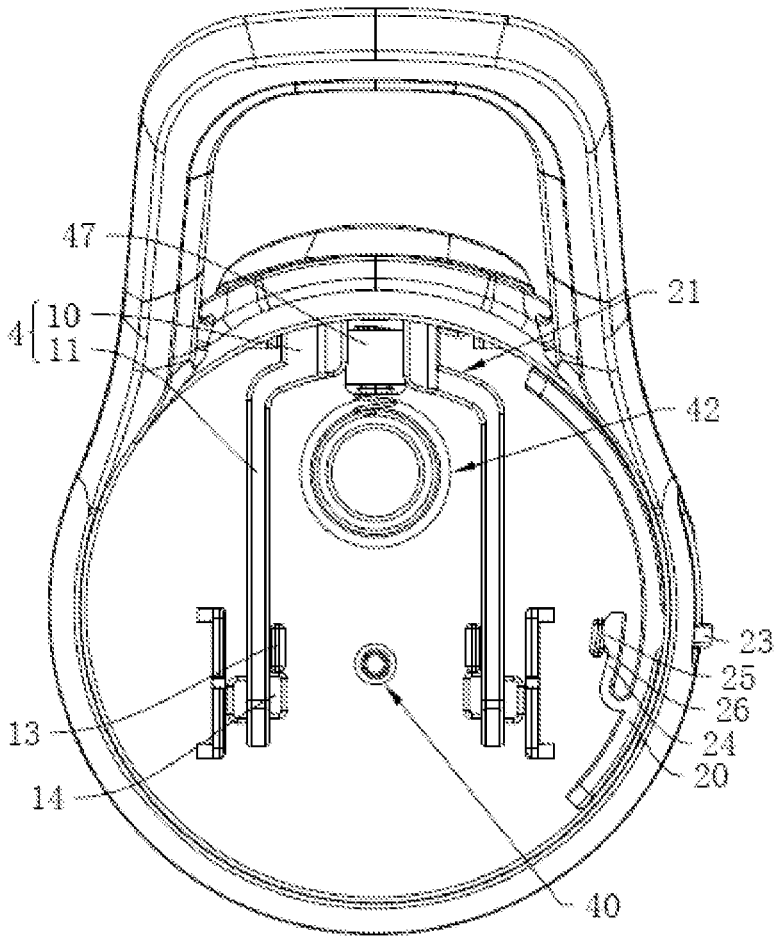
FIG. 6 is a schematic diagram of the installation position of a locking piece.
Figure 7:
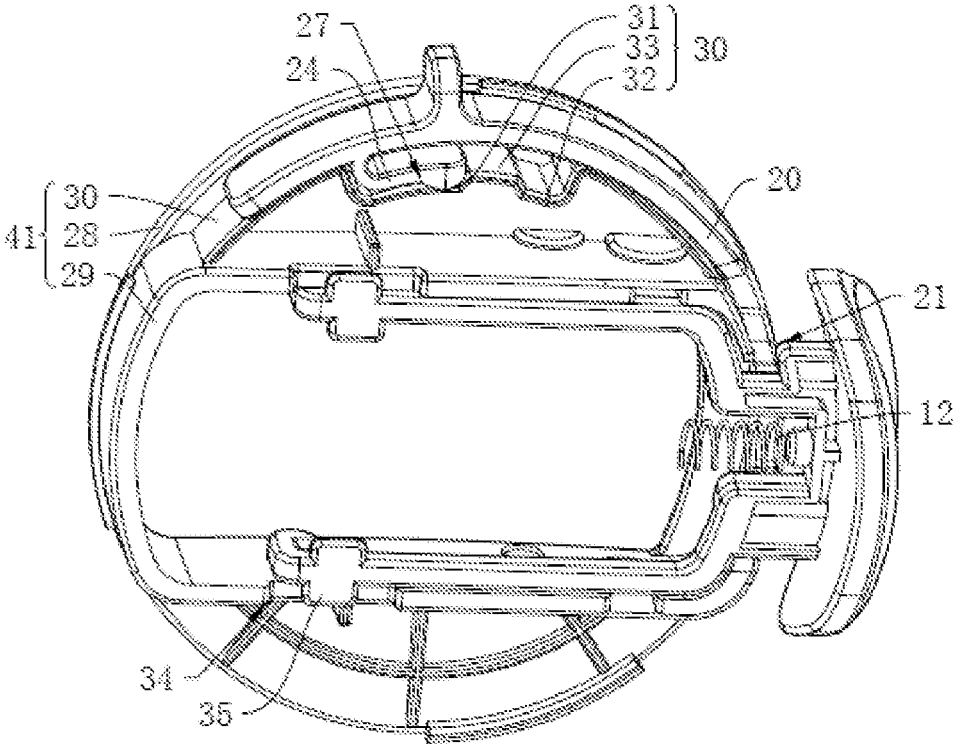
FIG. 7 is a schematic connection diagram of a covering part and the locking piece.

Referring to FIG. 3, FIG. 6 and FIG. 7, a control groove 9 is formed in a side wall of the carrier 1, and the control groove 9 penetrates through the side wall of the carrier 1 to connect the receiving cavity 5 to the outside of the carrier 1; the control member 4 comprises a first control part 10 and a second control part 11, the first control part 10 penetrates into the control groove 9 and extends out of the carrier 1, and the second connecting protrusions 8 are integrally fixed to the second control part 11; when the first control part 10 of the control member 4 is pressed outside the carrier 1, the second control part 11 of the control member 4 will slide in the receiving cavity 5 to drive the second connecting protrusions 8 to move; in addition, a portion, outside the carrier 1, of the first control part 10 is located at a position away from the end of the first water outlet part 2 in the folded state, that is, a pressing portion of the control member 4 is located behind the first water outlet part 2, such that users can press the control member 4 with the index finger to drive the first water outlet part 2 to move when holding the container, and can drink water smoothly in the pressing process.

Referring to FIG. 3, FIG. 6 and FIG. 7, a return element 12 is arranged on the carrier 1, a return block 47 is integrally fixed to the bottom of an inner side of the receiving cavity 5, a return groove 48 is formed in the return block 47, the return element 12 is elastic and arranged in the return groove 48, the first control part 10 and the second control part 11 are both rod-like, the return block 47 will not hinder the movement of the first control part 10 and the second control part 11, and a pressing portion is integrally formed in an end, away from the second control part 11, of the first control part 10; in this embodiment, the return element 12 is a spring, one end of the spring abuts against the bottom of an inner side of the return groove 48, and the other end of the spring abuts against the pressing portion of the first control part 10; the return element 12 is used for pushing the control member 4 to move away from the receiving cavity 5, that is, the return element 12 drives the first control part 10 to move to return; first stop blocks 13 are integrally fixed to the carrier 1 and arranged at the bottom of the inner side of the receiving cavity 5, second stop blocks 14 are integrally fixed to a side wall of the second control part 11 and is able to come in contact with the first stop blocks 13, the second stop blocks 14 can move with the second control part 11, and the first stop blocks 13 are arranged on movement paths of the second stop blocks 14; and when the return element 12 pushes the control member 4 to move, the second stop blocks 14 move accordingly to come in contact with the first stop block 13, and at this moment, the second stop blocks 14 are stopped from moving, such that the return element 12 is prevented from being separated from the carrier 1.

Referring to FIG. 3 and FIG. 5, a contact protrusion 15 is integrally fixed to a side wall of the support part 6, the rotating shaft of the support part 6 is arranged on the contact protrusion 15, a first plane 16, a second plane 17 and an arc surface 18 are arranged on the contact protrusion 15, and the first plane 16 is flush with an end face of the support part 6; when the support part 6 is snapped in the receiving cavity 5, the end face of the support part 6 looks smooth and aesthetic in the presence of the first plane 16; the second plane 17 is in contact with the moving part 3, and the arc surface 18 facilitates the rotation of the support part 6; a moving groove 19 is formed in the moving part 3, the support part 6 penetrates into the moving groove 19; when the first connecting protrusions 7 on the moving part 3 are in snap fit with the second connecting protrusions 8, the end face of the support part 6 and an end face of the moving part 3 are attached together and are both horizontal, a rotating shaft of the moving part 3 is spaced apart from the end face of the moving part 3 by a certain distance and thus will not hinder the rotation of the support part 6; because the first water outlet part 2 is made from silicone, the first water outlet part 2 can bounce back and drive the moving part 3 to move; when bouncing to an extreme position, the first water outlet part 2 becomes oblique and will not affect liquid circulation, such that users can drink water smoothly; at this moment, the second plane 17 is in contact with the moving part 3, and the moving part 3 is oblique, such that the moving part 3 is supported by the second plane 17; in this embodiment, the rotation direction of the moving part 3 is the same as the rotation direction of the support part 6.

Referring to FIG. 3, FIG. 6 and FIG. 7, a locking piece 20 is slidably arranged in the receiving cavity 5, and the locking piece 20 can slide in the receiving cavity 5 around the axis of the receiving cavity 5 and is mainly used for hindering the movement of the control member 4 to prevent the control member 4 from moving in a direction for separating the first connecting protrusions 7 and the second connecting protrusions 8; a locking groove 21 is formed in the control member 4 and located in the first control part 10, and when the sliding piece 20 slides into the locking groove 21, the control member 4 cannot move anymore, thus reducing the possibility that the first water outlet part 2 is opened due to mistouch of the control member 4.

Referring to FIG. 3, FIG. 6 and FIG. 7, an operating groove 22 is formed in the carrier 1, the operating groove 22 penetrates through the carrier 1 and is connected to the receiving cavity 5, a locking protrusion 23 is integrally fixed to the locking piece 20, and the locking protrusion 23 penetrates into the operating groove 22 and extends out of the carrier 1, such that the movement of the locking piece 20 can be controlled outside the carrier 1; a positioning piece 24 is integrally fixed to the locking piece 20 and is L-shaped, one end of the positioning piece 24 is integrally fixed to an end face of the locking piece 20, a buffer gap is reserved between the positioning piece 24 and the locking piece 20, a positioning protrusion 25 is integrally fixed to the positioning piece 24, a positioning guide surface 27 is arranged on the positioning protrusion 25, and a first limiting part 26 is integrally fixed to the carrier 1 and can facilitate the installation of the locking piece 20. The first limiting part 26 can limit the locking piece 20 in the installation process, such that the locking piece 20 can be installed smoothly.

Referring to FIG. 1, FIG. 6 and FIG. 7, a covering part 41 is arranged in the receiving cavity 5 and fixed to an inner wall of the receiving cavity in a clamped manner and covers the receiving cavity 5, and the covering part 41 has a space for the first water outlet part 2, the moving part 3 and the control member 4 to move; the covering part 41 comprises a first horizontal part 28, a first vertical part 29 and a second vertical part 30, the first horizontal part 28 is flush with the end face of the carrier 1, the first vertical part 29 is arranged vertically, abuts against the bottom of the inner side of the receiving cavity 5 and is frame-shaped, the first water outlet part 2, the support part 6, the moving part 3 and the control member 4 are all arranged in the first vertical part 29, the support part 6 and the moving part 3 are rotatably connected to an inner wall of the first vertical part 29, the control member 4 can slide in the first vertical part 29, the first control part 10 is arranged between the first limiting part 26 and the inner wall of the first vertical part 29, and a second limiting part is integrally fixed to an inner wall of the first control part 10 and abuts against an upper end face of the second control part 11, such that the possibility of upward deflection of the second control part 11 in the vertical direction is reduced.

Referring to FIG. 1, FIG. 6 and FIG. 7, the second vertical part 30 is perpendicular to the first horizontal part 28, a space for the locking piece 20 to move is reserved between the second vertical part 30 and the inner wall of the receiving cavity 5, the second vertical part 30 comprises a first positioning part 31 and a second positioning part 32, a transition part 33 is fixed between the first positioning part 31 and the second positioning part 32, ends of the transition part 33 in contact with the first positioning part 31 and the second positioning part 32 are oblique, the first positioning part 31 is used for receiving the positioning piece 24 and the positioning protrusion 25, and the second positioning part 32 is used for receiving the positioning protrusion 25; when the locking piece 20 is separated from the locking groove 21, both the positioning piece 24 and the positioning protrusion 25 are located in the first positioning part 31, and under the restriction of a side wall of the first positioning part 31, the positioning piece 24 and the positioning protrusion 25 will not move, thus guaranteeing the stability of the positioning piece 24 and the locking piece 20; when the locking piece 20 penetrates into the locking groove 21, the positioning protrusion 25 penetrates into the second positioning part 32 and is limited by a side wall of the second positioning part 32, such that the locking piece 20 is less likely to disengage from the locking groove 21; when the locking piece 20 drives the positioning piece 24 to move, a side wall of the transition part 33 pushes the positioning protrusion 25 to enable the positioning piece 24 to incline; and when the positioning protrusion 25 is located in the second positioning part 32, a side wall of the positioning piece 24 is attached to an end face of the transition part 33.

Referring to FIG. 1, FIG. 6 and FIG. 7, a limiting groove 34 is formed in the first vertical part 29, a limiting block 35 is integrally fixed to the control member 4 and arranged on a side wall of the second control part 11, the limiting block 35 penetrates into the limiting groove 34 and is able to slide in the limiting groove, and the limiting block 35 and the limiting groove 34 further limit the position of the control member 4.

Referring to FIG. 1 and FIG. 2, a support channel 36 is integrally fixed to the carrier 1, the support channel 36 is hollow and coaxial with the connecting hole 42, and the first water outlet part 2 penetrates into the support channel 36 and is fixed to an inner wall of the support channel 36 in a clamped manner, such that the possibility of deflection of the first water outlet part 2 is reduced.

Referring to FIG. 1 and FIG. 2, a connecting part 37 is fixed to the carrier 1 and used for connecting the carrier 1 and the container, the connecting part 37 is threadedly connected to the container to fix the carrier 1 to the container, a sealing part 38 is fixed to the carrier 1 in a clamped manner, the sealing part 38 is made from silicone or rubber and is ring-shaped, an outer wall of the sealing part 38 is attached to the connecting part 37, and a pulling part 39 is integrally fixed to an inner wall of the sealing part 38 and facilitates assembly or disassembly of the sealing part 39; moreover, an air hole 40 is formed in the carrier 1, the air hole 40 penetrates through the carrier 1 in the axial direction of the carrier 1 and is configured to facilitate liquid circulation, and when the first water outlet part 2 is located in the receiving cavity 5, the side wall of the first water outlet part 2 seals the air hole 40, thus reducing the possibility of liquid leaking.

Referring to FIG. 1 and FIG. 2, a handle 50 is fixed to the side wall of the carrier 1. Users can carry the container and the carrier 1 easily by means of the handle 50.

Embodiment 2

Figure 8:
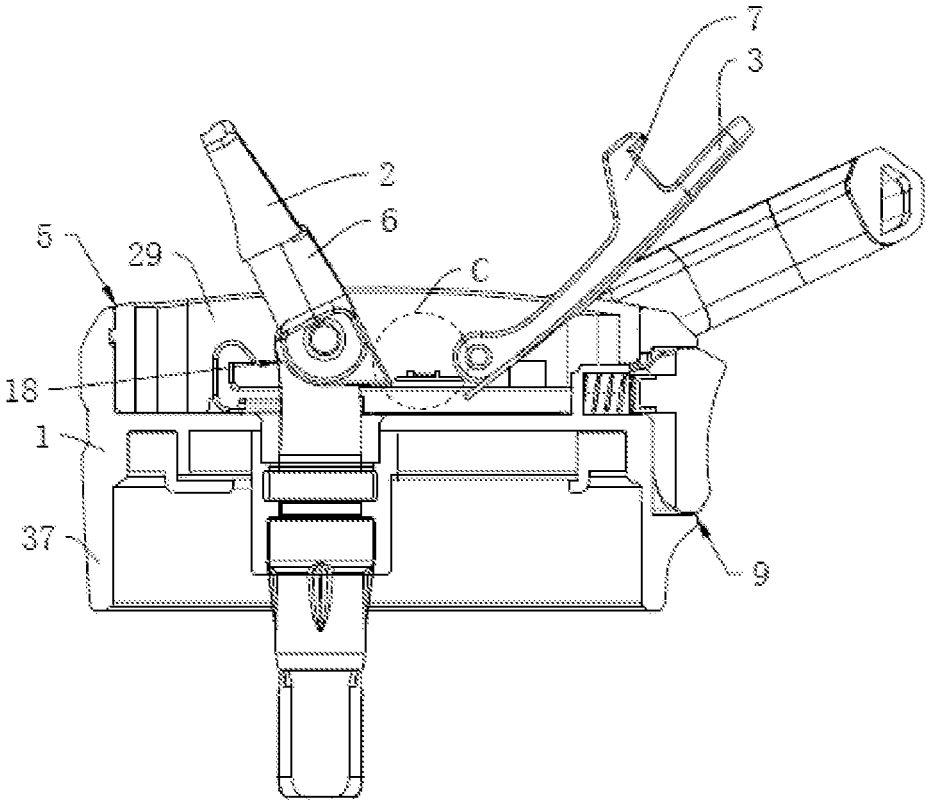
FIG. 8 is a sectional view of a main structure according to Embodiment 2 of the application.
Figure 9:
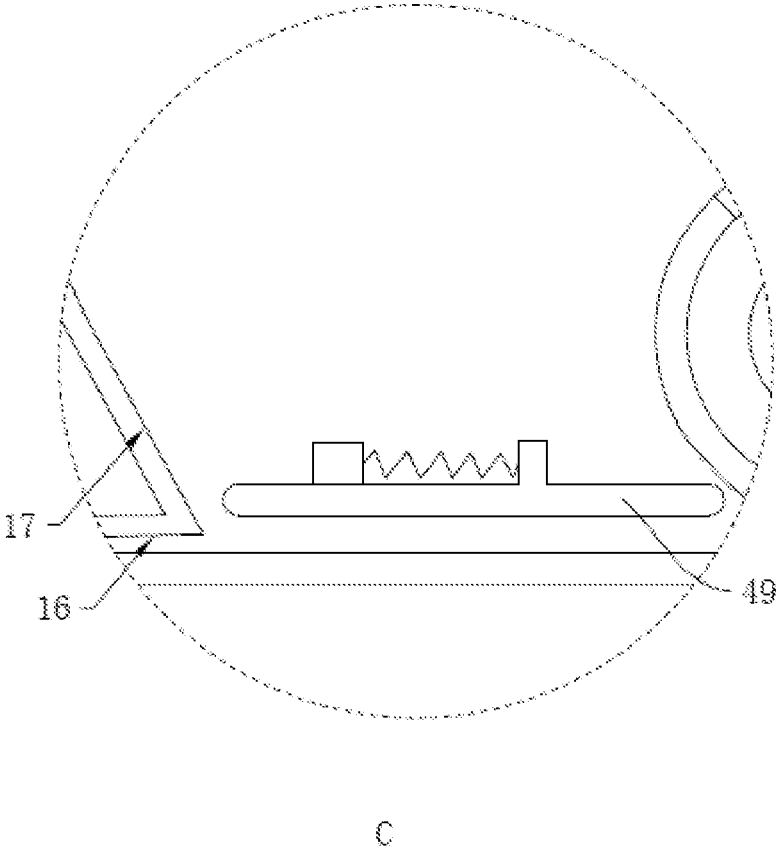
FIG. 9 is an enlarged view of part C in FIG. 8.

Embodiment 2 of the application is different from Embodiment 1 in that the rotation direction of the moving part 3 is opposite to the rotation direction of the support part 6, as shown in FIG. 8 and FIG. 9, that is, the rotating shaft of the moving part 3 and the rotating shaft of the support part 6 are respectively arranged at two ends of the inside of the first vertical part 29 in a length direction, wherein the moving part 3 is as long as an opening in the first support part 6, that is, the moving part 3 can completely cover the opening in the first support part 6, thus improving the aesthetics of the surface of the carrier 1.

Referring to FIG. 8 and FIG. 9, a contact protrusion 15 is fixed to the side wall of the support part 6. In this embodiment, when the support part 6 abuts against the side wall of the first vertical part 29, the first plane 16 is parallel to the bottom of the inner side of the receiving cavity 5, the second plane 17 is in contact with the first plane 16 and is oblique, and the arc surface 18 is in contact with the first plane 16 and the second plane 17, thus facilitating the rotation of the support part 6; the rotating shaft of the moving part 3 is oval and is in smooth transition with the end face of the moving part 3; a transition rod 49 is slidably arranged between the moving part 3 and the support part 6 and slidably connected to the inner wall of the first vertical part 29, a spring used for pushing the transition rod 49 to move towards the rotating shaft of the moving part 3 is arranged on a side wall of the transition rod 49, and the transition rod 49 is arranged above the second control part 11; when the first water outlet part 2 is controlled to be closed, the moving part 3 is pushed to rotate, the transition rod 49 is pushed to slide in the rotation process of the moving part 3 and comes in contact with the second plane 17; because the second plane 17 is oblique when the first plane 16 is parallel to the bottom of the inner side of the receiving cavity 5, and a portion, close to the moving part 3, of the second plane 17 is lower than a portion, away from the moving part 3, of the second plane 17, the support part 6 will be driven to rotate when the transition rod 49 pushes the second plane 17; because length of the support part 6 is less than that of the moving part 3, the moving part 3 can cover the support part 6 when the transition rod 49 cannot further push the support part 6 to move, such that the support part 6 can be driven to move synchronously to allow the first water outlet part 2 to be received in the receiving cavity 5.

In addition, a lug may be arranged on the side face to prevent the moving part from bouncing back.

The implementation principle of the direct-drinking container lid with a one-key control function provided by the invention is as follows: when drinking water, users press the control member 4 to allow the first water outlet part 2 to bounce out of the receiving cavity 5, and then the users can drink water directly; after drinking, the users can press the moving part 3 to allow the first water outlet part 2 to be received in the receiving cavity 5 again to prevent liquid circulation, thus reducing the possibility of liquid leaking; moreover, the control member 4 can be locked or not locked by controlling the locking groove 21, thus reducing the possibility of autonomous startup of the control member 4.

The above embodiments are all preferred ones of the application and are not intended to limit the protection scope of the application. Therefore, all equivalent variations made according to the structure, shape and principle of the application should also within the protection scope of the application.

What is claimed is:

1. A direct-drinking container lid with a one-key control function, comprising a carrier (1);

a first water outlet part (2) which is bendable and resilient, penetrates through the carrier (1) and is used for liquid circulation;

a moving part (3) which is able to drive the first water outlet part (2) to be folded to prevent liquid circulation; and a control member (4) which is movably arranged on the carrier (1) and used for controlling the moving part (3) to move;

wherein first connecting protrusions (7) are fixed to the moving part (3), second connecting protrusions (8) are fixed to the control member (4), and the first connecting protrusions (7) are in snap fit with the second connecting protrusions (8); and wherein a control groove (9) is formed in a side wall of the carrier (1), the control member (4) comprises a first control part (10) and a second control part (11), the first control part (10) penetrates into the control groove (9) and extends out of the carrier (1), the second connecting protrusions (8) are fixed to the second control part (11), and a portion, outside the carrier (1), of the first control part (10) is located at a position away from the end of the first water outlet part (2) in a folded state.

2. The direct-drinking container lid with a one-key control function according to claim 1, wherein a receiving cavity (5) is formed in the carrier (1), the first water outlet part (2) and the control member (4) are movably arranged in the receiving cavity (5), and when an end of the first water outlet part (2) is received in the receiving cavity (5), liquid is prevented from circulating in the first water outlet part (2).

3. The direct-drinking container lid with a one-key control function according to claim 1, wherein a support part (6) is rotatably arranged on the carrier (1), the first water outlet part (2) penetrates into the support part (6), and the support part (6) is able to drive the first water outlet part (2) to move.

4. The direct-drinking container lid with a one-key control function according to claim 1, wherein a return element (12) is arranged on the carrier (1), and the return element (12) is elastic and is able to drive the first control part (10) to move to return.

5. The direct-drinking container lid with a one-key control function according to claim 1, wherein first stop blocks (13) for limiting a position of the control member (4) are fixed to the carrier (1), and second stop blocks (14) which are able to come in contact with the first blocks (13) are fixed to the second control part (11).

6. The direct-drinking container lid with a one-key control function according to claim 3, wherein a contact protrusion (15) is fixed to a side wall of the support part (6), a rotating shaft of the support part (6) is arranged on the contact protrusion (15), and a first plane (16), a second plane (17) and an arc surface (18) which facilitate rotation of the contact protrusion (15) are arranged on the contact protrusion (15).

7. The direct-drinking container lid with a one-key control function according to claim 6, wherein a moving groove (19) is formed in the moving part (3), the support part (6) penetrates into the moving groove (19), and when the first connecting protrusions (7) are in snap fit with the second connecting protrusions (8), an end face of the support part (6) is attached to an end face of the moving part (3).

8. The direct-drinking container lid with a one-key control function according to claim 2, wherein a locking piece (20) is slidably arranged in the receiving cavity (5) and is able to slide to hinder movement of the control member (4).

9. The direct-drinking container lid with a one-key control function according to claim 8, wherein a locking groove (21) is formed in the control member (4), and the locking piece (20) is able to slide into the locking groove (21) to prevent the control member (4) from moving.

10. The direct-drinking container lid with a one-key control function according to claim 8, wherein an operating groove (22) connected to the receiving cavity (5) is formed in the carrier (1), and a locking protrusion (23) is fixed to the locking piece (20) and penetrates into the operating groove (22).

11. The direct-drinking container lid with a one-key control function according to claim 8, wherein a positioning piece (24) is fixed to the locking piece (20), a buffer gap is reserved between the positioning piece (24) and the locking piece (20), a positioning protrusion (25) is fixed to the positioning piece (24), and a first limiting part (26) is fixed to the carrier (1).

12. The direct-drinking container lid with a one-key control function according to claim 11, wherein a covering part (41) is arranged in the receiving cavity (5), the covering part (41) covers the receiving cavity (5) and has a space for the first water outlet part (2), the moving part (3) and the control part (4) to move; the covering part (41) comprises a first horizontal part (28), a first vertical part (29) and a second vertical part (30), and end faces of the first horizontal part (28) and the moving part (3) are flush when the first horizontal part (28) and the moving part (3) are horizontal; and the first vertical part (29) abuts against a bottom of an inner side of the receiving cavity (5), and the first water outlet part (2), the moving part (3) and the control member (4) are all arranged in the first vertical part (29).

13. The direct-drinking container lid with a one-key control function according to claim 12, wherein a space for the locking piece (20) to move is reserved between the second vertical part (30) and an inner wall of the receiving cavity (5); the second vertical part (30) comprises a first positioning part (31) and a second positioning part (32), a transition part (33) is fixed between the first positioning part (31) and the second positioning part (32), and ends of the transition part (33) in contact with the first positioning part (31) and the second positioning part (32) are oblique; and the first positioning part (31) is used for receiving the positioning piece (24) and the positioning protrusion (25), and the second positioning part (32) is used for receiving the positioning protrusion (25).

14. The direct-drinking container lid with a one-key control function according to claim 12, wherein a positioning guide surface (27) is arranged on the positioning protrusion (25).

15. The direct-drinking container lid with a one-key control function according to claim 12, wherein a limiting groove (34) is formed in the first vertical part (29), a limiting block (35) is fixed to the control member (4), and the limiting block (35) penetrates into the limiting groove (34) and is able to slide in the limiting groove (34).

16. The direct-drinking container lid with a one-key control function according to claim 1, wherein a support channel (36) is fixed to the carrier (1), and the first water outlet part (2) is fixed in the support channel (36).

17. The direct-drinking container lid with a one-key control function according to claim 1, wherein a connecting part (37) for connecting the carrier (1) to a container is fixed to the carrier (1), a sealing part (38) is fixed to the carrier (1), the sealing part (38) is ring-shaped and is attached to the connecting part (37), and a pulling part (39) is fixed to the sealing part (38).

18. The direct-drinking container lid with a one-key control function according to claim 1, wherein an air hole (40) is formed in the carrier (1).

* * * * *